US011450988B2

(12) United States Patent
Li et al.

(10) Patent No.: US 11,450,988 B2
(45) Date of Patent: Sep. 20, 2022

(54) STRAP CONNECTOR WITH STRAP UNLOCKING DEVICE

(71) Applicant: DONGGUAN LUXSHARE TECHNOLOGIES CO., LTD, Dongguan (CN)

(72) Inventors: Tiesheng Li, Dongguan (CN); Bingbao Liu, Dongguan (CN); Liang Ma, Dongguan (CN); Qiongnan Chen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 15 days.

(21) Appl. No.: 17/089,197

(22) Filed: Nov. 4, 2020

(65) Prior Publication Data

US 2021/0135402 A1 May 6, 2021

(30) Foreign Application Priority Data

Nov. 6, 2019 (CN) ..... 201911079449.0

(51) Int. Cl.
*H01R 13/50* (2006.01)
*H01R 13/633* (2006.01)
*H01R 13/627* (2006.01)

(52) U.S. Cl.
CPC ..... *H01R 13/6335* (2013.01); *H01R 13/50* (2013.01); *H01R 13/6275* (2013.01)

(58) Field of Classification Search
CPC ..... H01R 13/6275; H01R 13/639; H01R 13/629; H01R 13/633; H01R 43/26; H01R 24/62; H01R 13/6582
See application file for complete search history.

(56) References Cited

U.S. PATENT DOCUMENTS 7,083,459 B1 8/2006 Wu et al.
8,251,735 B2 * 8/2012 Wu ..... H01R 13/5825 439/353

(Continued)

FOREIGN PATENT DOCUMENTS

CN 201584583 U 9/2010
CN 102610960 A 7/2012

(Continued)

OTHER PUBLICATIONS

Chinese Office Action and Search Report for Chinese Application No. 201911079449.0, dated Feb. 8, 2021.

*Primary Examiner* — Truc T Nguyen
(74) *Attorney, Agent, or Firm* — Birch, Stewart, Kolasch & Birch, LLP

(57) ABSTRACT

The present disclosure discloses a strap connector. The strap connector includes an insulating body having a tongue plate, a number of conductive terminals and a strap unlocking device installed on the insulating body. The strap unlocking device includes a locking piece for locking with a mating connector and a pull strap connected to the locking piece. The strap connector further includes a guide rail piece arranged separately from the locking piece and installed on the insulating body. A part of the pull strap is located between the guide rail piece and the insulating body. As a result, the structure of the strap unlocking device is simplified, and it is convenient to install the strap unlocking device on the insulating body.

17 Claims, 12 Drawing Sheets

(56) References Cited

U.S. PATENT DOCUMENTS

| | | | | |
|---|---|---|---|---|
| 10,879,637 | B2 * | 12/2020 | Chung | H01R 24/60 |
| 2006/0189197 | A1 * | 8/2006 | Reed | H01R 13/6275 439/352 |
| 2011/0294334 | A1 * | 12/2011 | Phillips | G02B 6/4201 439/357 |
| 2012/0329305 | A1 * | 12/2012 | Ritter | H01R 13/6275 439/350 |
| 2013/0288507 | A1 * | 10/2013 | Zhu | H01R 13/62 439/345 |
| 2014/0038447 | A1 * | 2/2014 | Brown | H01R 13/62 439/350 |
| 2019/0181586 | A1 | 6/2019 | Takano et al. | |
| 2020/0076123 | A1 * | 3/2020 | Yang | H01R 13/506 |
| 2020/0194932 | A1 * | 6/2020 | Henry | H01R 13/629 |

FOREIGN PATENT DOCUMENTS

| | | | |
|---|---|---|---|
| CN | 102651520 | A | 8/2012 |
| CN | 204505258 | U | 8/2015 |
| CN | 205724200 | U | 11/2016 |
| CN | 208608427 | U | 3/2019 |
| CN | 208797273 | U | 4/2019 |
| CN | 209029582 | U | 6/2019 |

* cited by examiner

STRAP CONNECTOR WITH STRAP UNLOCKING DEVICE

CROSS-REFERENCE TO RELATED APPLICATION

This patent application claims priority of a Chinese Patent Application No. 201911079449.0, filed on Nov. 6, 2019 and titled "strap connector", the entire content of which is incorporated herein by reference.

TECHNICAL FIELD

The present disclosure relates to a strap connector, which belongs to a technical field of connectors.

BACKGROUND

Limited by the current high-speed development of servers, interface miniaturization has become a trend. Both a board connector and a cable connector tend to be dense, which leads to less space available for an unlocking device when male and female connectors are mated. Besides, under the demand of miniaturization, the unlocking device is more difficult to process and shape.

Therefore, it is necessary to design an unlocking device adapted to be used in a miniaturized connector, which is easy to operate and simple in structure.

SUMMARY

An object of the present disclosure is to provide a strap connector with a simple structure.

In order to achieve the above object, the present disclosure adopts the following technical solution: a strap connector comprising an insulating body having a tongue plate, a plurality of conductive terminals and a strap unlocking device installed on the insulating body. Each of the conductive terminals includes a contact portion located on the tongue plate. The strap unlocking device includes a locking piece for locking with a mating connector and a pull strap connected to the locking piece. The strap connector further includes a guide rail piece which is arranged separately from the locking piece and installed on the insulating body. A part of the pull strap is located between the guide rail piece and the insulating body.

Compared with the prior art, the present disclosure simplifies the structure of the strap unlocking device by separating the locking piece and the guide rail piece, and facilitates the installation of the strap unlocking device on the insulating body. In addition, the strap unlocking device can be unlocked by pressing or by pulling the strap, which is convenient to use.

DETAILED DESCRIPTION

Figure 1:
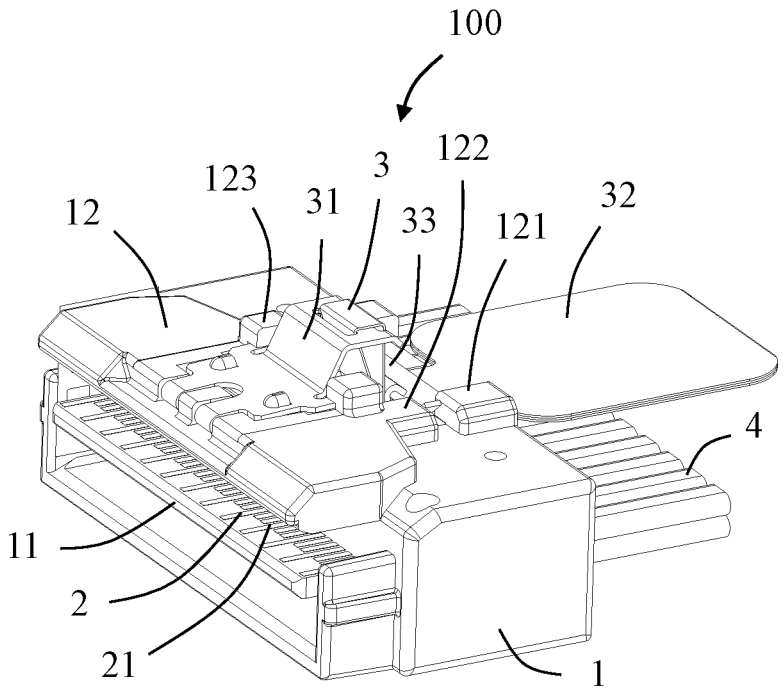
FIG. 1 is a perspective schematic view of a strap connector in accordance with an embodiment of the present disclosure.
Figure 2:
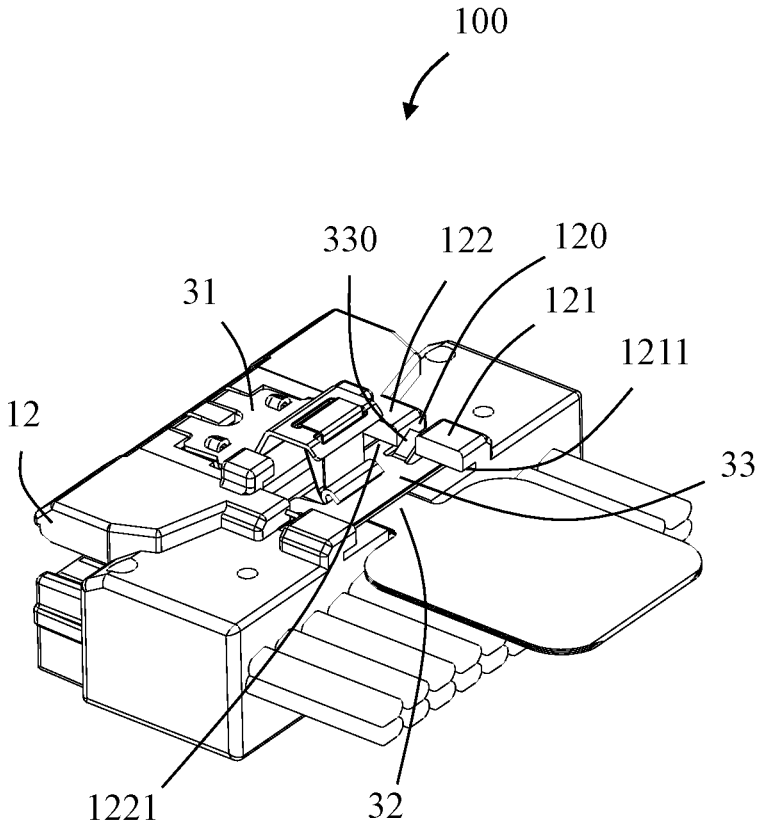
FIG. 2 is a perspective schematic view of FIG. 1 from another angle.
Figure 3:
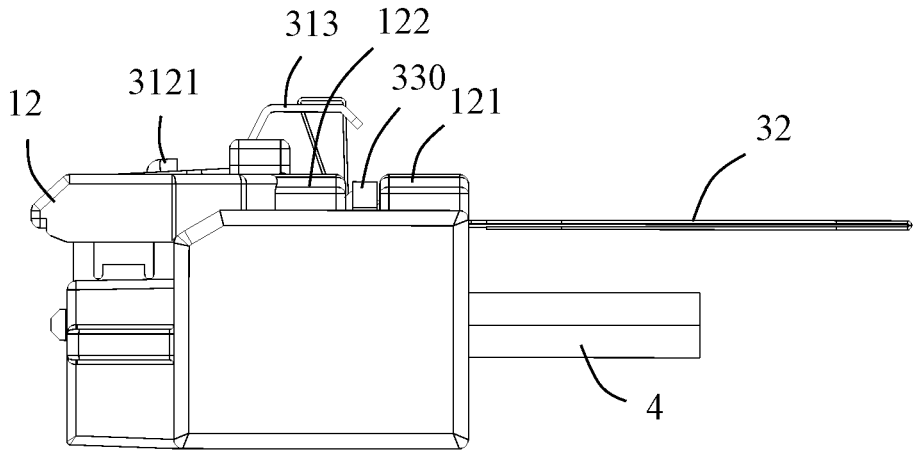
FIG. 3 is a side view of FIG. 1.
Figure 4:
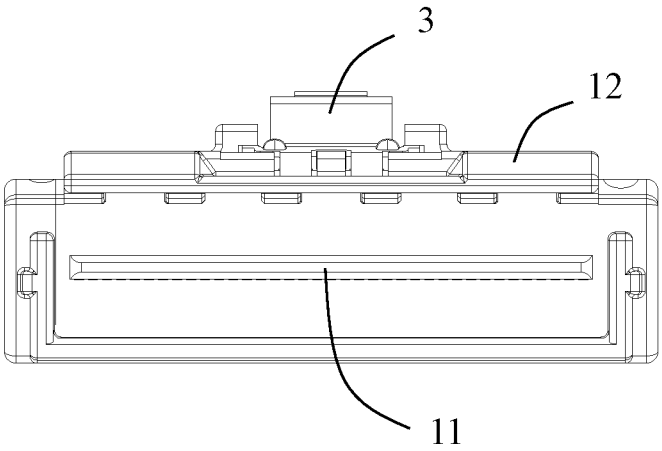
FIG. 4 is a front view of FIG. 1.
Figure 5:
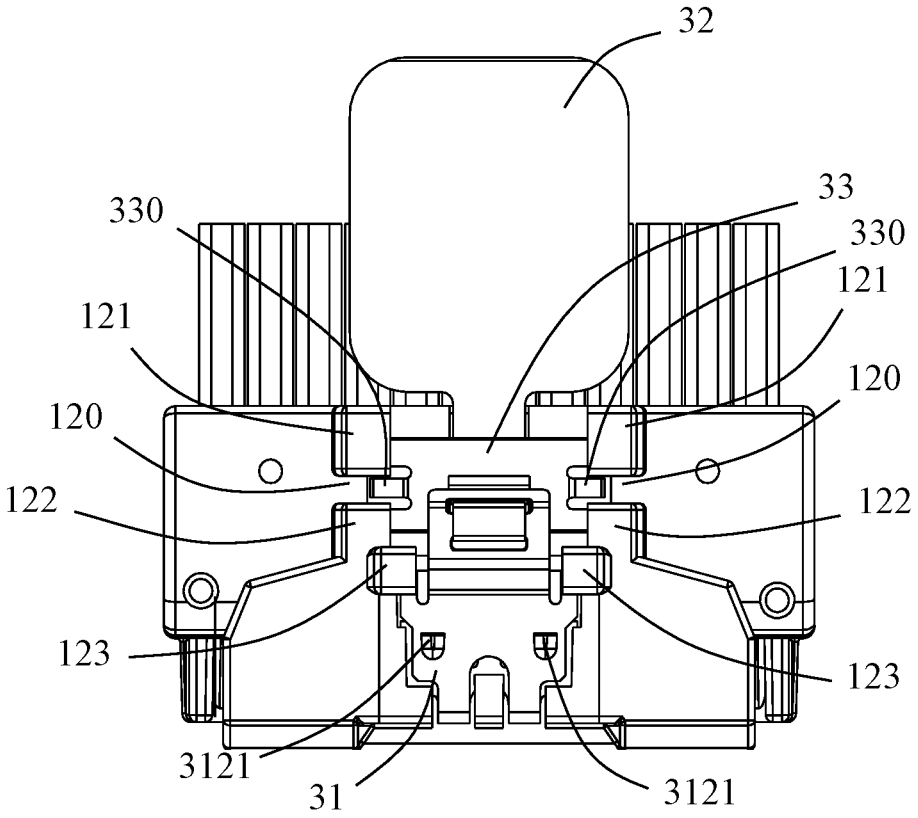
FIG. 5 is a top view of the strap connector in accordance with an embodiment of the present disclosure.

Referring to FIG. 1 to FIG. 13, the present disclosure discloses a strap connector 100 which includes an insulating body 1, a plurality of conductive terminals 2 and a strap unlocking device 3 installed on the insulating body 1. Referring to FIG. 1, the insulating body 1 is provided with a tongue plate 11, and each of the conductive terminals 2 is provided with a contact portion 21 located on the tongue plate 11. In an illustrated embodiment of the present disclosure, the strap connector 100 is an SFP cable connector, and the conductive terminals 2 are connected to a plurality of cables 4. SEP is short for Small Form-factor Pluggable. Each contact portion 21 has a flat plate shape and the contact portions 21 are distributed on upper and lower surfaces of the tongue plate 11, respectively. In other embodiments, a combination of the contact portions 21 and the tongue plate 11 may also be a circuit board with contact pieces or golden fingers (PIN) formed thereon.

In order to describe the technical solution of the present disclosure more clearly, a direction close to a mating surface of the insulating housing 1 is defined as front, and a direction away from the mating surface of the insulating housing 1 is defined as rear. The insulating body 1 includes a top wall 12 which is located above the tongue plate 11 and is vertically separated from the tongue plate 11 by a certain distance. Referring to FIGS. 1 to 6, the top wall 12 is provided with a first pair of raised portions 121, a pair of first slots 1211 respectively located under the first pair of raised portions 121, a second pair of raised portions 122 respectively located in front of the first pair of raised portions 121, a pair of second slots 1221 respectively located under the second pair of raised portions 122, a pair of grooves 120 respectively located between the first pair of raised portions 121 and the second pair of raised portions 122, a third pair of raised portions 123 respectively located in front of the second pair of raised portions 122 (that is, the third pair of raised portions 123 are located on a side away from the first pair of raised portions 121), and a pair of third slots 1231 respectively located under the third pair of raised portions 123.

Figure 6:
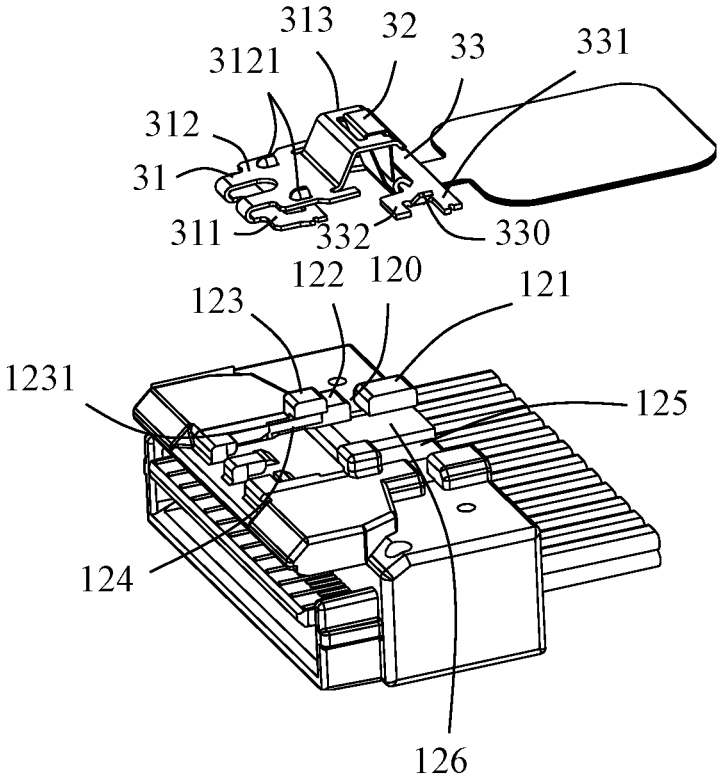
FIG. 6 is a partially exploded perspective view of FIG. 1 with a strap unlocking device separated.
Figure 7:
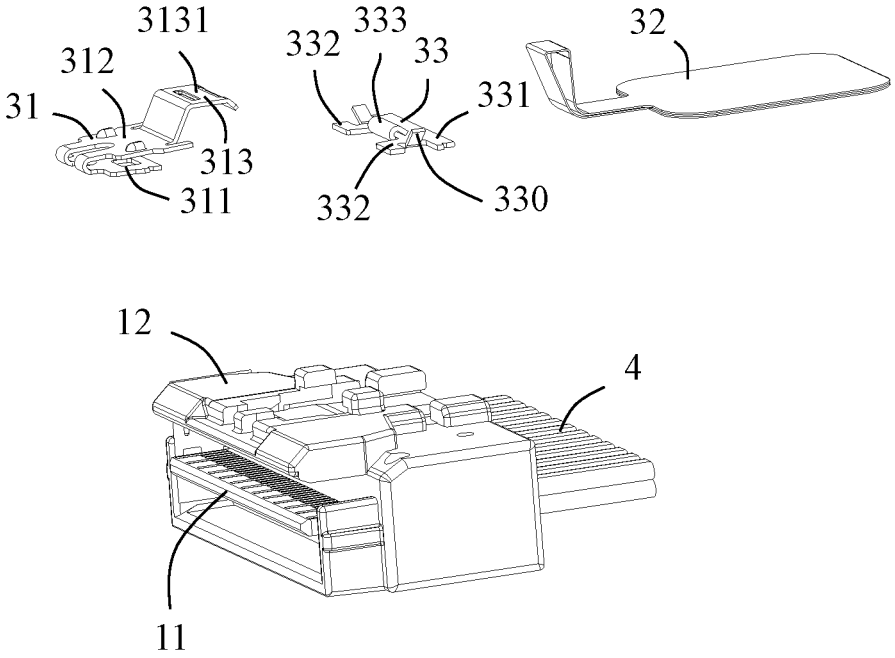
FIG. 7 is a further partial exploded view of FIG. 6.
Figure 8:
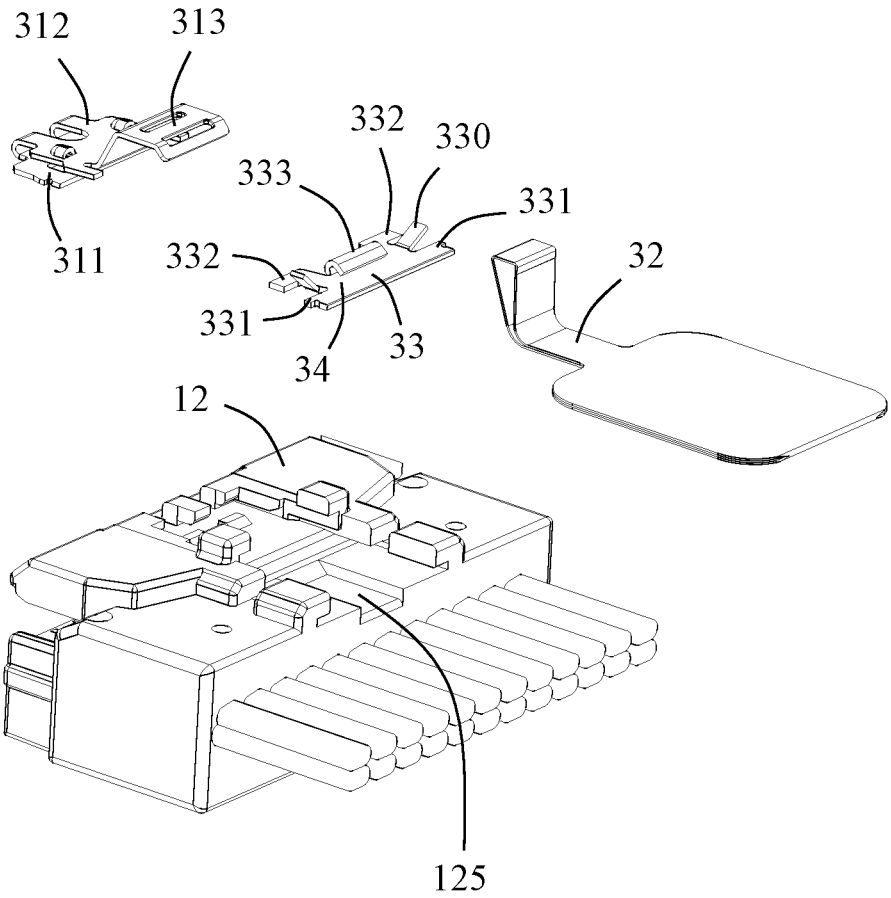
FIG. 8 is a partially exploded view of FIG. 7 from another angle.
Figure 9:
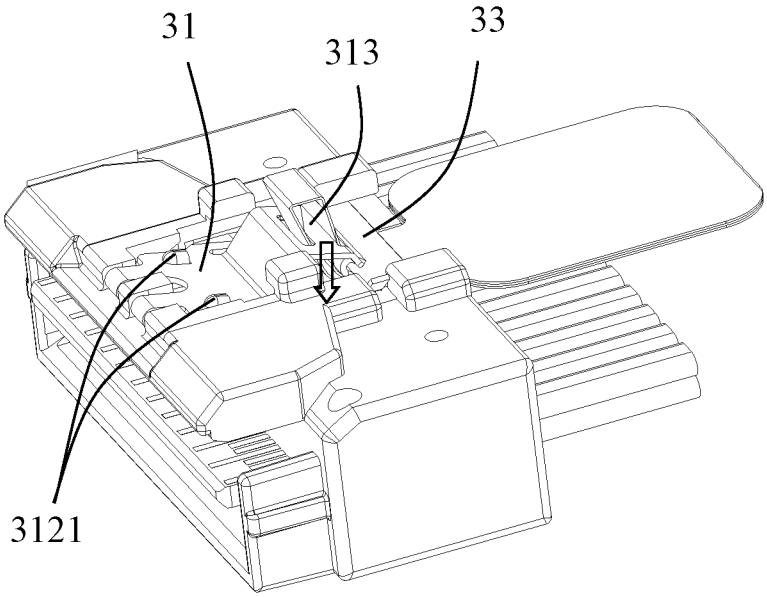
FIG. 9 is a perspective schematic view of the strap connector in FIG. 1 when it is pressed to be under an unlocking status.
Figure 10:
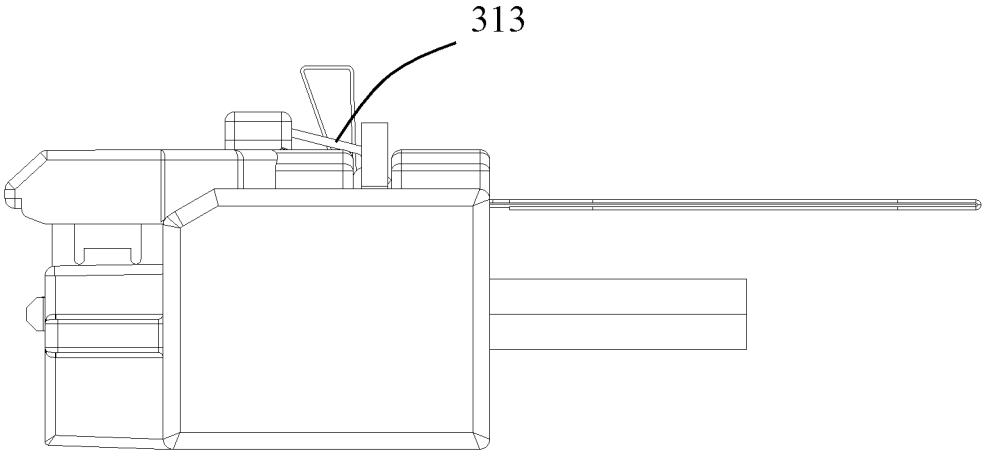
FIG. 10 is a side view of FIG. 9.
Figure 11:
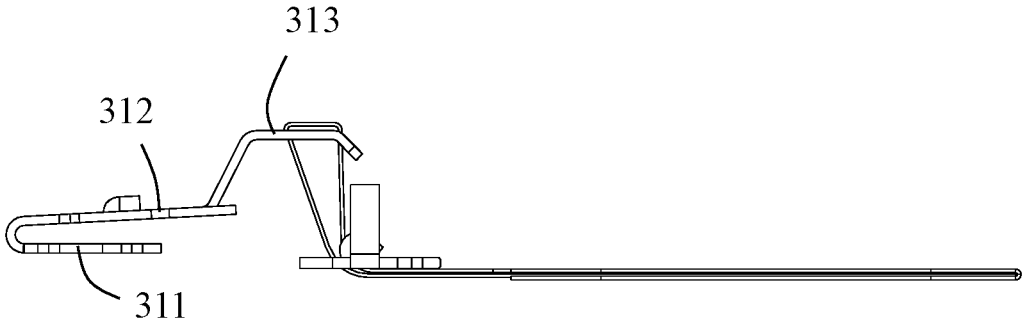
FIG. 11 is a side view of the strap unlocking device in FIG. 1.
Figure 12:
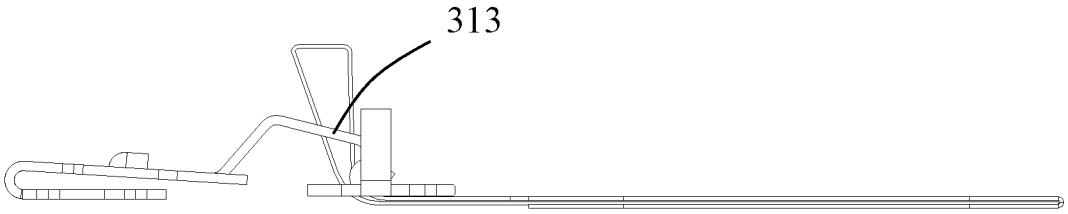
FIG. 12 is a side view of the strap unlocking device in FIG. 9.
Figure 13:
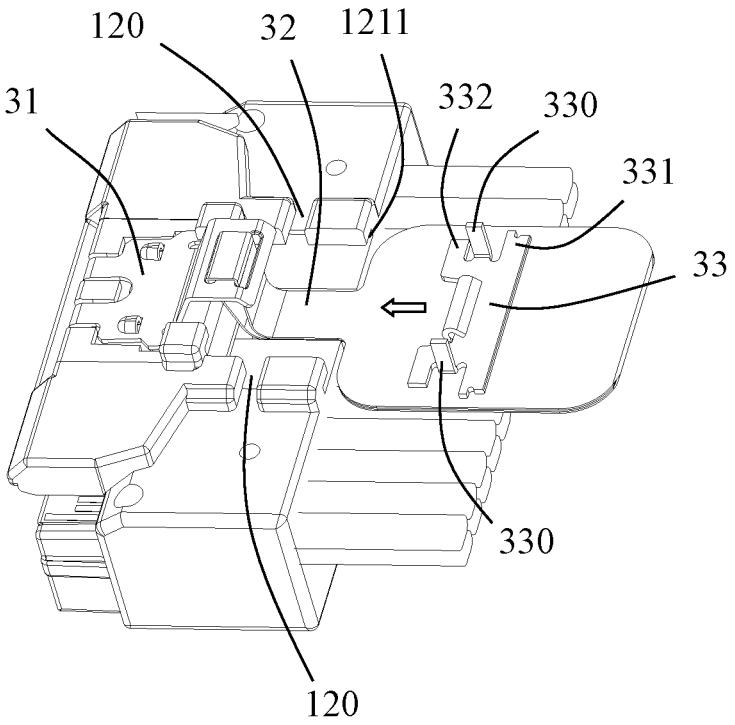
FIG. 13 is a perspective schematic view of a guide rail piece before being installed on the insulating body.

Referring to FIGS. 6 to 8, the strap unlocking device 3 includes a locking piece 31 for locking with a mating connector, a pull strap 32 connected to the locking piece 31, and a guide rail piece 33 provided separately from the locking piece 31 and installed on the insulating body 1. The second pair of raised portions 122 are located between the locking piece 31 and the first pair of raised portions 121 along a mating direction along which the strap connector 100 is assembled to the mating connector.

Referring to FIG. 6 to FIG. 8 and FIG. 11, in the illustrated embodiment of the present disclosure, materials of the locking piece 31 and the insulating body 1 are different. For example, the insulating body 1 is made of a plastic material, while the locking piece 31 is made of a metal material. The locking piece 31 is roughly U-shaped and includes a fixing portion 311 fixed to the top wall 12 and a locking portion 312 bent from an end of the fixing portion 311. In other embodiments, the locking piece 31 is made of the same material as the insulating body 1. For example, they are both made of a plastic material. Referring to FIG. 6, in the illustrated embodiment of the present disclosure, the top wall 12 is provided with a slot 124 for fixation of the fixing portion 311. Of course, in other embodiments, the fixing portion 311 may also be fixed to the top wall 12 by insert molding.

The locking portion 312 is provided with a pair of locking protrusions 3121 for locking with the mating connector. In the illustrated embodiment of the present disclosure, the locking protrusions 3121 are arranged side by side along a width direction of the locking portion 312. In an embodiment of the present disclosure, the locking protrusions 3121 are stamped from the locking portion 312. In the illustrated embodiment of the present disclosure, the locking piece 31 is inserted into the insulating body 1 along a rear-to-front direction. Both sides of the locking portion 312 are located in the third slots 1231, and the third pair of raised portions 123 are capable of limiting a highest position of the locking portion 312 when the locking portion 312 moves upwardly.

Referring to FIGS. 6 to 8, the locking piece 31 is further provided with an elevated portion 313 extending upwardly and rearwardly from the locking portion 312. That is, the elevated portion 313 extends toward the first pair of raised portions 121. The elevated portion 313 is provided with a buckle portion 3131 for mating with the pull strap 32. The buckle portion 3131 is capable of driving the locking portion 312 to move downwardly when it is pressed downwardly by an external force or pulled by the pull strap 32 to achieve unlocking, which is convenient for use.

In the illustrated embodiment of the present disclosure, the guide rail piece 33 may be made of a metal material or an insulating material. The guide rail piece 33 is provided with a main body portion 34 (referring to FIG. 8) which is of a substantially flat configuration. With this arrangement, a height of the guide rail piece 33 can be lowered and it is convenient to be installed to the insulating body 1. Specifically, in the illustrated embodiment of the present disclosure, the guide rail piece 33 is provided with a pair of first horizontal extensions 331 inserted into the first slots 1211 along the rear-to-front direction, a pair of upper extension portions 330 located on both sides and extending upwardly, and a pair of second horizontal extensions 332 inserted into the second slots 1221 along the rear-to-front direction. The first pair of raised portions 121 and the second pair of raised portions 122 are used to restrict the movement of the guide rail piece 33 along a vertical direction perpendicular to the mating direction. In addition, referring to FIG. 13 and FIG. 2, the upper extension portions 330 are bent both outwardly to be locked in the grooves 120. The two opposite sides of the first pair of raised portions 121 and the second pair of raised portions 122 are used to restrict the movement of the guide rail piece 33 in the horizontal direction.

The pull strap 32 is tied to the buckle portion 3131 and extends downwardly and rearwardly beyond the insulating body 1. Referring to FIG. 6, the top wall 12 is provided with a supporting surface 126 and a strap groove 125 recessed downwardly from the supporting surface 126. The pull strap 32 fastened to the buckle portion 3131 extends from the locking piece 31 along the strap groove 125. The supporting surface 126 supports the main body 34. A part of the pull strap 32 is located between the guide piece 33 and the insulating body 1. Referring to FIG. 1, the guide rail piece 33 presses on the pull strap 32 to downwardly restrict the pull strap 32, thereby restricting a force direction of the pull strap 32. In addition, referring to FIGS. 6 to 8, the guide piece 33 is also provided with a flanging portion 333. The flanging portion 333 is adapted for guiding the pull strap 32 when it is pulled back, and the flanging portion 333 extends from the main body portion 34 in a direction opposite to the strap groove 125.

Compared with the prior art, the present disclosure simplifies the structure of each element by separately disposing the locking piece 31 and the guide piece 33. During assembling, the pull strap 32 is firstly assembled to the locking piece 31. Since the locking piece 31 has a simpler structure compared to the prior art, it is convenient to assemble the pull strap 32 to the locking piece 31. At this time, one end of the draw strap 32 is tied to the buckle portion 3131, and the other end extends from the strap groove 125 to the insulating body 1. Then, the guide piece 33 is mounted on the top wall 12 of the insulating housing 1 along the rear-to-front direction (referring to FIG. 13). The main body portion 34 having the flat plate shape can be supported on the supporting surface 126 of the top wall 12. Finally, the upper extension portion 330 is bent to both sides to be locked in the grooves 120 to facilitate installation. In addition, the strap unlocking device 3 can be unlocked by pressing (referring to FIG. 9, FIG. 10 and FIG. 12), or by pulling straps, which is convenient to use.

When the pull strap 32 is used for unlocking, the pull strap 32 is pulled back in the horizontal direction. Under the guidance of the flanging portion 333, the pull strap 32 moves rearwardly smoothly, and the elevated portion 313 is driven by the pull strap 32 to move downwardly, so that the height of the lock portion 312 is lowered. As a result, the lock protrusion 3121 and the mating connector are unlocked. Then a force is applied to continue to pull the pull strap 32 so as to disengage the strap connector 100 from the mating connector.

The above embodiments are only used to illustrate the present disclosure and not to limit the technical solutions described in the present disclosure. The understanding of this specification should be based on those skilled in the art. Descriptions of directions, such as "front", "back", "left", "right", "top" and "bottom", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A strap connector, comprising:

an insulating body comprising a tongue plate which is configured to be inserted into a mating connector along a first direction;

a plurality of conductive terminals each of which comprises a contact portion located on the tongue plate; and a strap unlocking device installed on the insulating body, the strap unlocking device comprising a locking piece for locking with the mating connector and a pull strap connected to the locking piece; wherein the strap connector further comprises a guide rail piece which is arranged separately from the locking piece and installed on the insulating body along the first direction; wherein a part of the pull strap is located between the guide rail piece and the insulating body;

wherein the top wall is provided with a supporting surface and a strap groove recessed downwardly from the supporting surface, the guide rail piece is provided with a flat body portion supported by the supporting surface, and the pull strap extends from the locking piece along the strap groove; and wherein the guide rail piece is provided with a flanging portion which guides the pull strap to be pulled rearwardly, and the flanging portion extends in a direction opposite to the strap groove.

2. The strap connector according to claim 1, wherein the insulating body comprises a top wall, the top wall is provided with a first pair of raised portions and a pair of first slots located under the first pair of raised portions, the guide rail piece is provided with a first horizontal extension inserted in the first slots, and the first pair of raised portions restrict a movement of the guide rail piece along a vertical direction.

3. The strap connector according to claim 2, wherein the top wall is provided with a second pair of raised portions which are located between the locking piece and the first pair of raised portions along a mating direction perpendicular to the vertical direction.

4. The strap connector according to claim 3, wherein the top wall is provided with a pair of grooves located between the first pair of raised portions and the second pair of raised portions along the mating direction, the guide rail piece is provided with a pair of upper extension portions which are bent to be locked in the grooves, and the first pair of raised portions and the second pair of raised portions restrict movements of the upper extension portions in a horizontal direction parallel to the mating direction.

5. The strap connector according to claim 3, wherein the top wall is provided with a pair of second slots located under the second pair of raised portions, the guide rail piece is provided with a pair of second horizontal extension portions inserted into the second slots along a rear-to-front direction, and the second pair of raised portions restrict the movement of the guide rail piece along the vertical direction.

6. The strap connector according to claim 3, wherein the locking piece is of a U-shaped configuration and comprises a fixing portion fixed to the top wall and a locking portion bent from an end of the fixing portion, the locking portion is provided with a locking protrusion adapted for locking with the mating connector; and wherein the top wall is provided with a third pair of raised portions located on a side of the second pair of raised portions away from the first pair of raised portions, and a pair of third slots located under the third pair of raised portions, both sides of the locking portion are inserted in the third slots.

7. The strap connector according to claim 6, wherein the locking piece is provided with an elevated portion extending upwardly from the locking portion and toward the first pair of raised portions, the elevated portion is provided with a buckle portion for mating with the pull strap, the buckle portion is capable of driving the locking portion to move downwardly to realize unlocking when the buckle portion is pressed down by an external force or pulled by the pull strap.

8. A strap connector, comprising:

an insulating body comprising a tongue plate which extends along a first direction;

a plurality of conductive terminals with contact portions located on the tongue plate;

a strap unlocking device installed on the insulating body, the strap unlocking device comprising a locking piece for locking with a mating connector and a pull strap assembled to the locking piece; and a guide rail piece provided separately from the locking piece and installed on the insulating body along the first direction; wherein the pull strap is restricted by the guide rail piece along a second direction perpendicular to the first direction; wherein the locking piece is capable of being driven by the pull strap so as to be lowered along the vertical direction from a locking status where the strap connector is in locking with the mating connector to an unlocking status where the strap connector is separable with the mating connector;

and wherein the insulating body comprises a top wall provided with a first pair of raised portions and a pair of first slots located under the first pair of raised portions, the guide rail piece is provided with a pair of first horizontal extensions inserted in the first slots along the first direction, and the first pair of raised portions restrict a movement of the guide rail piece along the second direction.

9. The strap connector according to claim 8, wherein the top wall is provided with a second pair of raised portions which are located between the locking piece and the first pair of raised portions along a mating direction perpendicular to the vertical direction.

10. The strap connector according to claim 9, wherein the top wall is provided with a pair of grooves located between the first pair of raised portions and the second pair of raised portions along the mating direction, the guide rail piece is provided with a pair of upper extension portions which are bent to be locked in the grooves, and the first pair of raised portions and the second pair of raised portions restrict movements of the upper extension portions in a horizontal direction parallel to the mating direction.

11. The strap connector according to claim 9, wherein the top wall is provided with a pair of second slots located under the second pair of raised portions, the guide rail piece is provided with a pair of second horizontal extension portions inserted into the second slots along a rear-to-front direction, and the second pair of raised portions restrict the movement of the guide rail piece along the vertical direction.

12. The strap connector according to claim 9, wherein the locking piece is of a U-shaped configuration and comprises a fixing portion fixed to the top wall and a locking portion bent from an end of the fixing portion, the locking portion is provided with a locking protrusion adapted for locking with the mating connector; and wherein the top wall is provided with a third pair of raised portions located on a side of the second pair of raised portions away from the first pair of raised portions, and a pair of third slots located under the third pair of raised portions, both sides of the locking portion are inserted in the third slots.

13. The strap connector according to claim 12, wherein the locking piece is provided with an elevated portion extending upwardly from the locking portion and toward the first pair of raised portions, the elevated portion is provided with a buckle portion for mating with the pull strap, the buckle portion is capable of driving the locking portion to move downwardly to realize unlocking when the buckle portion is pressed down by an external force or pulled by the pull strap.

14. The strap connector according to claim 8, wherein the top wall is provided with a supporting surface and a strap groove recessed downwardly from the supporting surface, the guide rail piece is provided with a flat body portion supported by the supporting surface, and the pull strap extends from the locking piece along the strap groove.

15. The strap connector according to claim 14, wherein the guide rail piece is provided with a flanging portion which guides the pull strap to be pulled rearwardly, and the flanging portion extends in a direction opposite to the strap groove.

16. A strap connector, comprising:

an insulating body comprising a tongue plate which is configured to be inserted into a mating connector along a first direction;

a plurality of conductive terminals at least partially located on the tongue plate;

a strap unlocking device comprising a locking piece for locking with the mating connector and a pull strap connected to the locking piece, the locking piece being assembled to the insulating body; and a guide rail piece arranged separately from the locking piece and assembled to the insulating body; wherein a part of the pull strap is located between the guide rail piece and the insulating body;

wherein the guide rail piece is provided with a flanging portion which guides the pull strap to be pulled along a direction opposite to the first direction; and wherein the flanging portion extends in the direction opposite to the first direction, and the flanging portion comprises a curved surface abutting against the pull strap.

17. The strap connector according to claim 16, wherein the locking piece is of a U-shaped configuration, and comprises a fixing portion fixed to the insulating body and a locking portion bent from an end of the fixing portion, the locking portion is provided with a locking protrusion adapted for locking with the mating connector.

* * * * *